US006299585B1

(12) United States Patent
Yoo

(10) Patent No.: US 6,299,585 B1
(45) Date of Patent: Oct. 9, 2001

(54) FINGER PRESSURE DEVICE

(76) Inventor: Dong-hoon Yoo, 807, 1-Dong, Hanyang, Apt., 32-5, Banpo-Dong, Seocho-Ku, Seoul (KR)

( * ) Notice: Subject to any disclaimer, the term of this patent is extended or adjusted under 35 U.S.C. 154(b) by 0 days.

(21) Appl. No.: 09/441,870

(22) Filed: Nov. 17, 1999

(30) Foreign Application Priority Data

Jul. 27, 1999 (KR) ..... 99-15096

(51) Int. Cl.[7] ..... A61H 15/00; A61H 7/00

(52) U.S. Cl. ..... 601/118; 601/128; 601/134; 601/135

(58) Field of Search ..... 601/113, 118, 601/128, 129, 131, 132, 134, 135

(56) References Cited

U.S. PATENT DOCUMENTS 4,191,178 * 3/1980 Wisnieski ..... 128/57
4,374,519 * 2/1983 Stauft ..... 128/57
4,577,858 * 3/1986 Higami ..... 272/67
4,846,159 * 7/1989 Anzai et al. ..... 128/57
5,389,063 * 2/1995 Wu ..... 601/135
5,413,551 * 5/1995 Wu ..... 601/46
5,531,666 * 7/1996 Hung ..... 601/129
5,580,336 * 12/1996 Coallier ..... 482/44

* cited by examiner

*Primary Examiner*—Michael A. Brown
*Assistant Examiner*—Benjamin K. Koo
(74) *Attorney, Agent, or Firm*—Richard M. Goldberg

(57) ABSTRACT

A finger pressure device 1 including semi-spherical bodies 10, 10' with a plurality of protuberances 11 on the outer surface, penetrating grooves 12, 12' in upper/lower part, a concavity 13, a convexity 14 in the internal center and circular groove 15; a circular rim 20 with a plurality of protuberances 21 on the outer surface, a projection 22 on the inner circumference and a space 23 to be placed between the two semi-spherical bodies; a coupling rod 30 with circular protuberances 31 on both sides to be inserted into the circular groove 15 of the semi-spherical bodies 10, 10' through the space 23 of the circular rim 20; and a cap 60 covering the upper/lower grooves 12, 12' after fastening with the bolt 40 and the nut 50.

7 Claims, 7 Drawing Sheets

FINGER PRESSURE DEVICE

BACKGROUND OF THE INVENTION

1. Field of the Invention

The present invention relates to a finger pressure device and more particularly, to a finger pressure device comprising two spherical finger pressure devices with a plurality of protuberances on the outer surface connected by a coupling rod to press artery points distributed on a palm and fingers. The spherical finger pressure device includes two semi-spherical bodies connected by a circular rim and the coupling rod revolves in various directions by the circular protuberances of the coupling rod and the circular rim. The present invention has an effect of promoting blood circulation by pressing artery points on a palm and fingers when one grips this device. The present invention has also a convenient portability and less possibility to be lost, and possibility as an amusement tool.

2. Description of the Prior Art

In general, finger pressure devices have semi-spherical frictional bodies with cone-shaped protuberances on the outer circumference, a connecting part attached with a bolt baton in the center of the inner circumference of the semi-circular capsule covered with golden foil, and ceramic powder filled inside of the semi-circular capsule. The semi-spherical frictional body is covered with a permanent magnet and closed hermetically by silicon, and is connected symmetrically with the openings formed on the both sides of the connecting board. A part of the connecting part of the semi-spherical frictional body is inserted into a groove of the connecting board and fastened with a bolt and a nut.

The major drawbacks of these devices are as follows, first, manufacturing costs are high due to its complicated structure, second, the effect of far-infrared rays from bio-ceramic powder by frictional heat is not that good because the far-infrared rays result only over a certain temperature. Third, a permanent magnet has a bad effect to old and feeble people. Fourth, the covering golden foil gets ugly as time goes by. Fifth, the cone-shaped protuberances on the outer circumference are so sharp that they are likely to leave scars on a skin of those who use the pressure device. Further, the semi-spherical frictional body revolves in only one direction, and therefore the pressing effect as a pressure device would be limited.

SUMMARY OF THE INVENTION

The present device was designed to solve the problems described as above. Therefore, an object of the present device is to provide an effect of improving blood circulation by press-stimulating artery points distributed on a palm and fingers by revolving two spherical finger pressure devices in various directions and also more convenient portability and a function as an amusement tool.

The present invention is a finger pressure device comprising semi-spherical bodies with a plurality of protuberances on the outer surface, penetrating grooves in the upper/lower part, a concavity, a convexity in the internal center and circular groove; a circular rim with a plurality of protuberances on the outer surface, a projection on inner circumference and a space to be placed between the two semi-spherical bodies; a coupling rod with a circular protuberance to be inserted into the circular groove of the semi-spherical bodies through the space of the circular rim; and a cap covering the upper/lower grooves after fastening the bolt and the nut.

BRIEF DESCRIPTION OF THE DRAWINGS

The other objects and features of the present invention will be hereinafter explained in detail with reference to the accompanying drawings, wherein.

DESCRIPTION OF THE PREFERRED EMBODIMENTS

Figure 1:
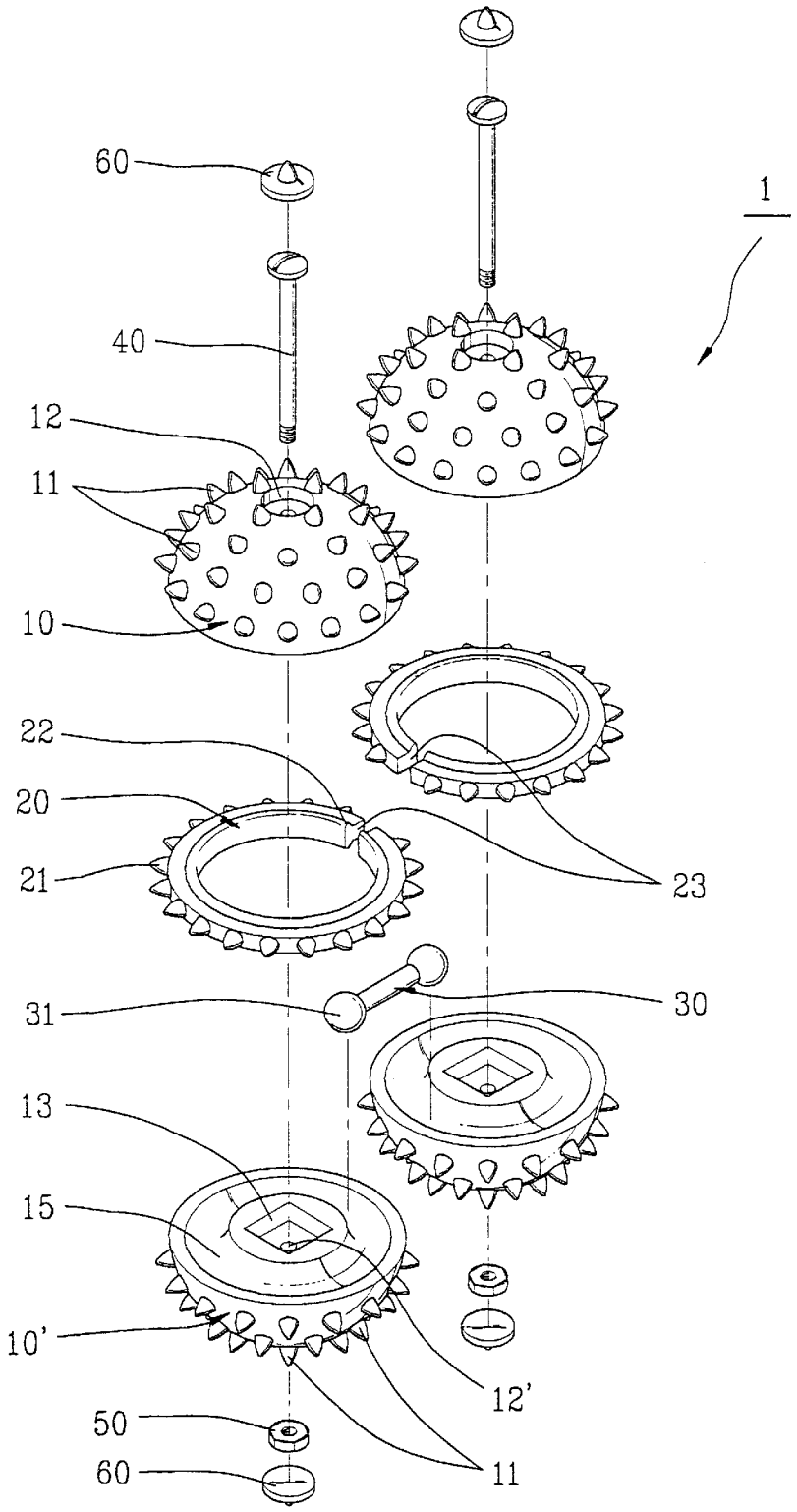
FIG. 1 is a disassembled perspective view of the present invention.
Figure 2:
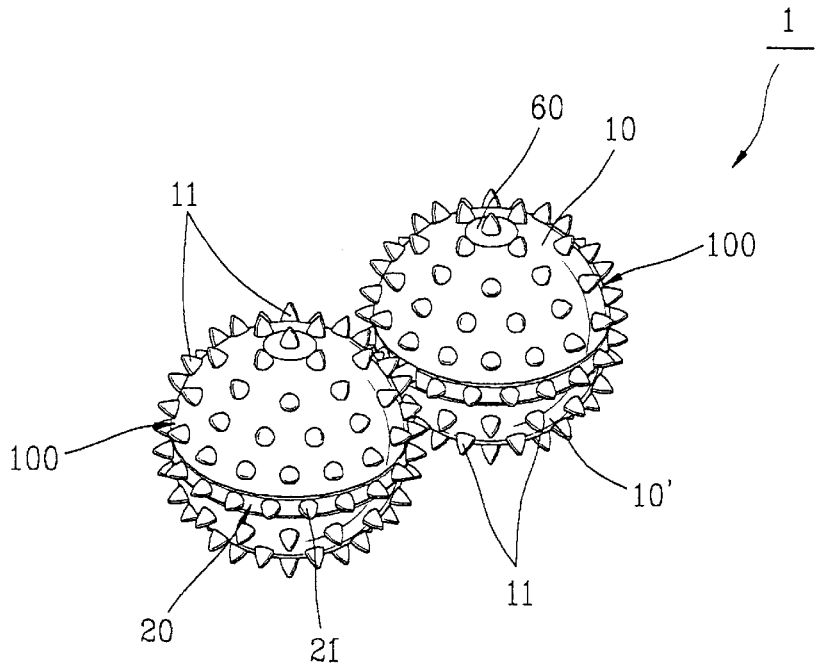
FIG. 2 is an assembled perspective view of the present invention.
Figure 3:
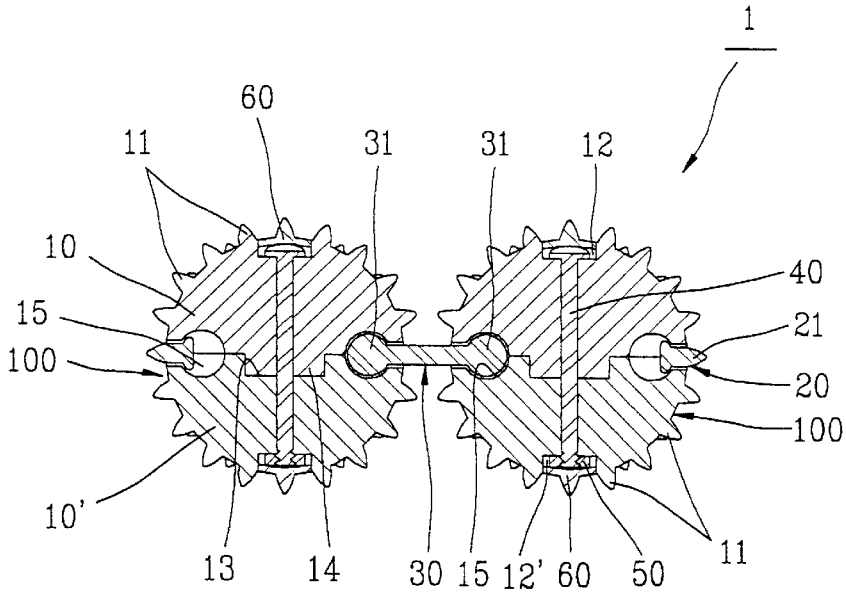
FIG. 3 is a vertical cross-sectional view of the present invention.

The present invention is a finger pressure device 1 comprising semi-spherical bodies 10, 10' with a plurality of protuberances 11 on the outer surface, penetrating grooves 12, 12' in the upper/lower part, concavity 13, convexity 14 in the internal center and a circular groove 15; a circular rim 20 with a plurality of protuberances 21 on the outer surface, a projection 22 on the inner circumference and a space 23 to be placed between the two semi-spherical bodies; a coupling rod 30 with a circular protuberance 31 to be inserted into circular groove 15 of the semi-spherical bodies 10, 10' through the space 23 of the circular rim 20; and a cap 60 covering the upper/lower grooves 12, 12' after fastening with the bolt 40 and the nut 50.

Unexplained numeral 200 refers to a hand.

Figure 4:
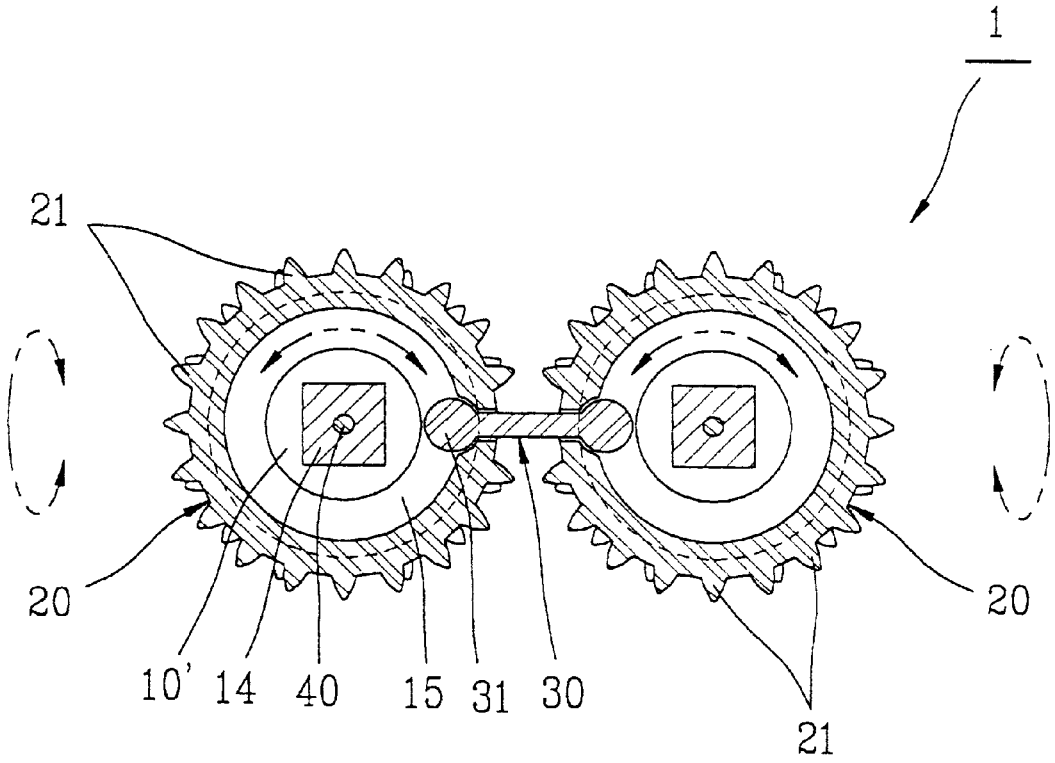
FIG. 4 is a cross-sectional view of the present invention.
Figure 5:
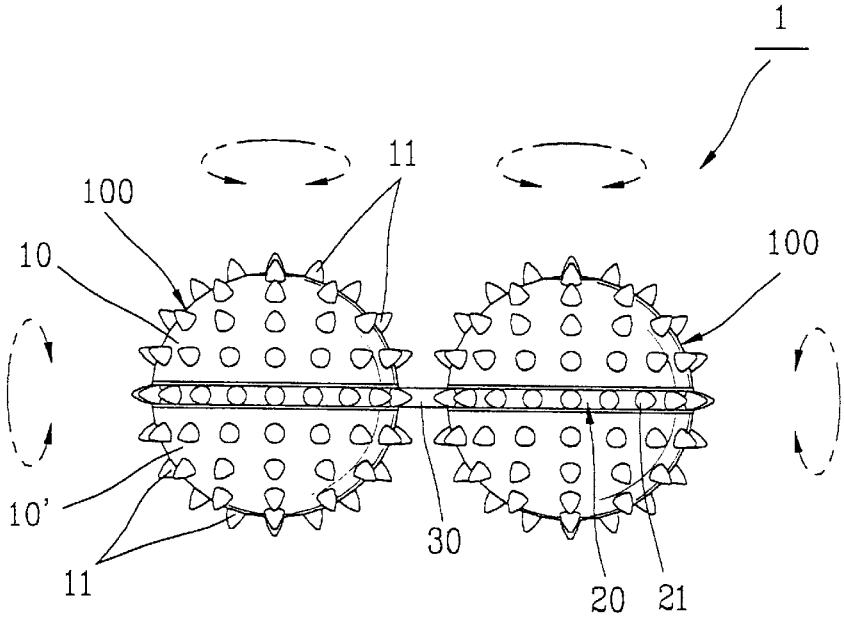
FIG. 5 is a front plan view showing a state of revolving the present invention.
Figure 6:
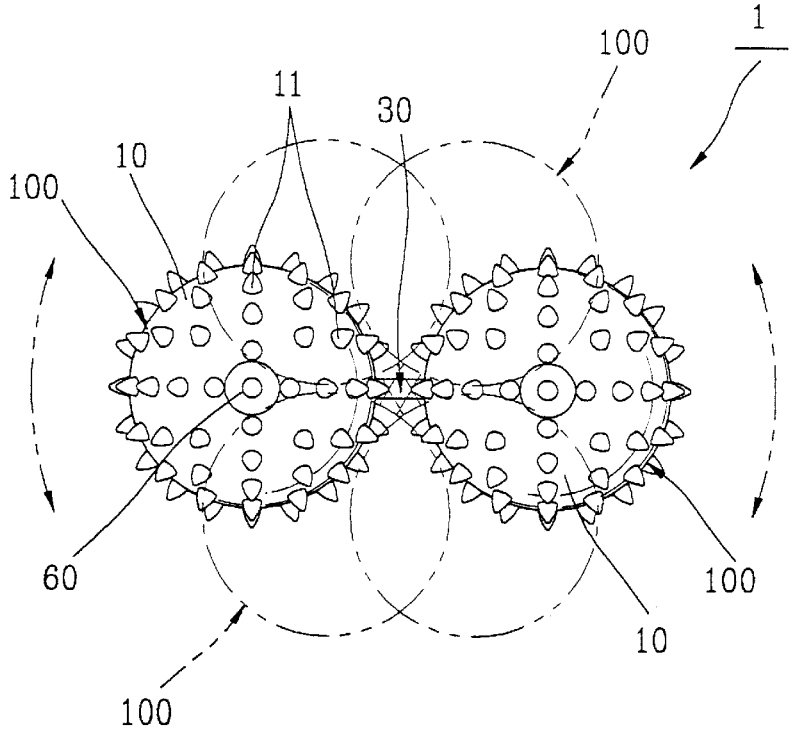
FIG. 6 is a top plan view showing a movement of the present invention.
Figure 7:
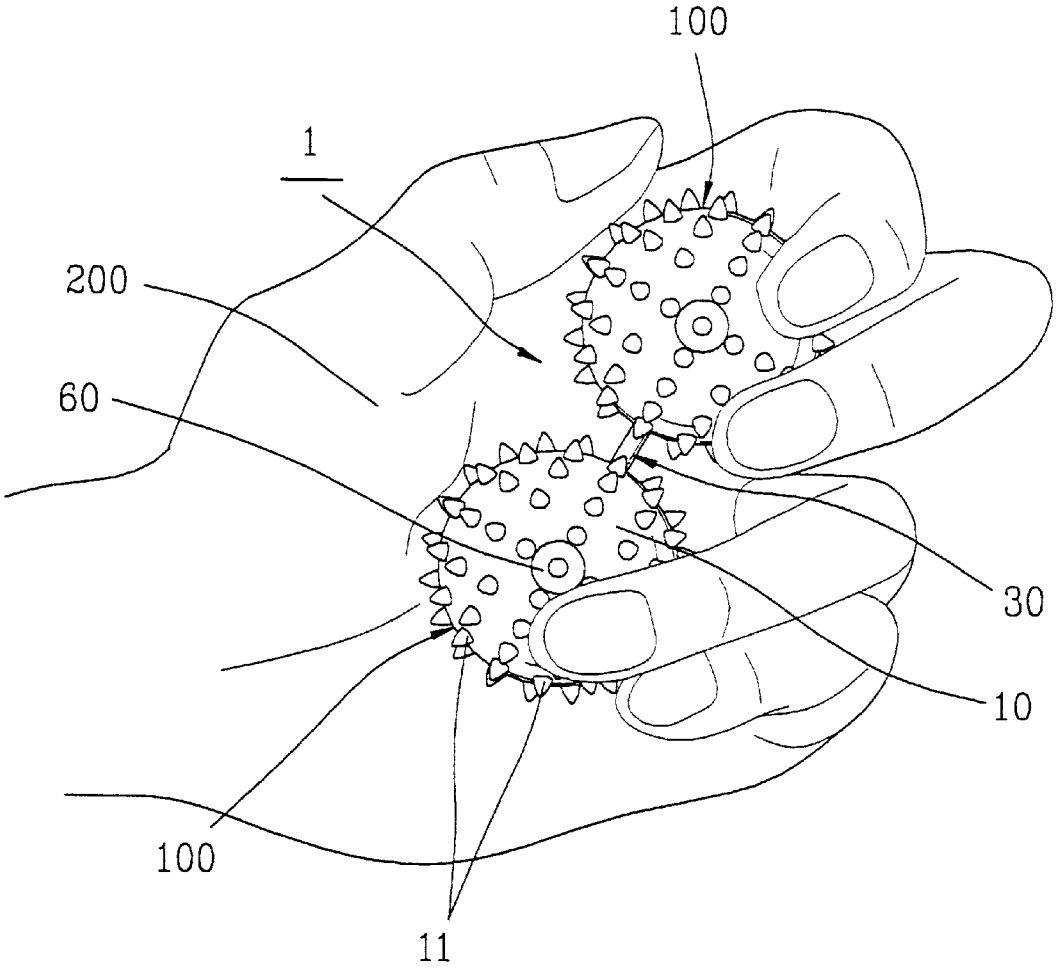
FIG. 7 is an illustrated view showing a using state of the present invention.

As shown in FIG. 4 and FIG. 5, two spherical finger pressure devices 10 revolve following an assumed line, with the circular protuberance 31 as a center at one part of the coupling rod 30 inserted in the circular groove 15 of the semi-circular bodies 10, 10'. As shown in FIG. 6, two spherical finger pressure devices 100 revolve following an assumed line, within the circular groove 15 by the coupling rod 30 inserted in the space 23 of the circular rim 20 inserted in the middle of the semi-circular bodies 10, 10'. As shown in FIG. 7, when one grips the finger pressure device 1 with a hand 200 and presses a plurality of artery points distributed on a palm and fingers by using a plurality of protuberances 11 attached on the outer circumference of the finger pressure device 1, and the protuberances 21 distributed on the outer circumference of the circular rim 20 can also be used as a function of a pressing device.

Figure 8:
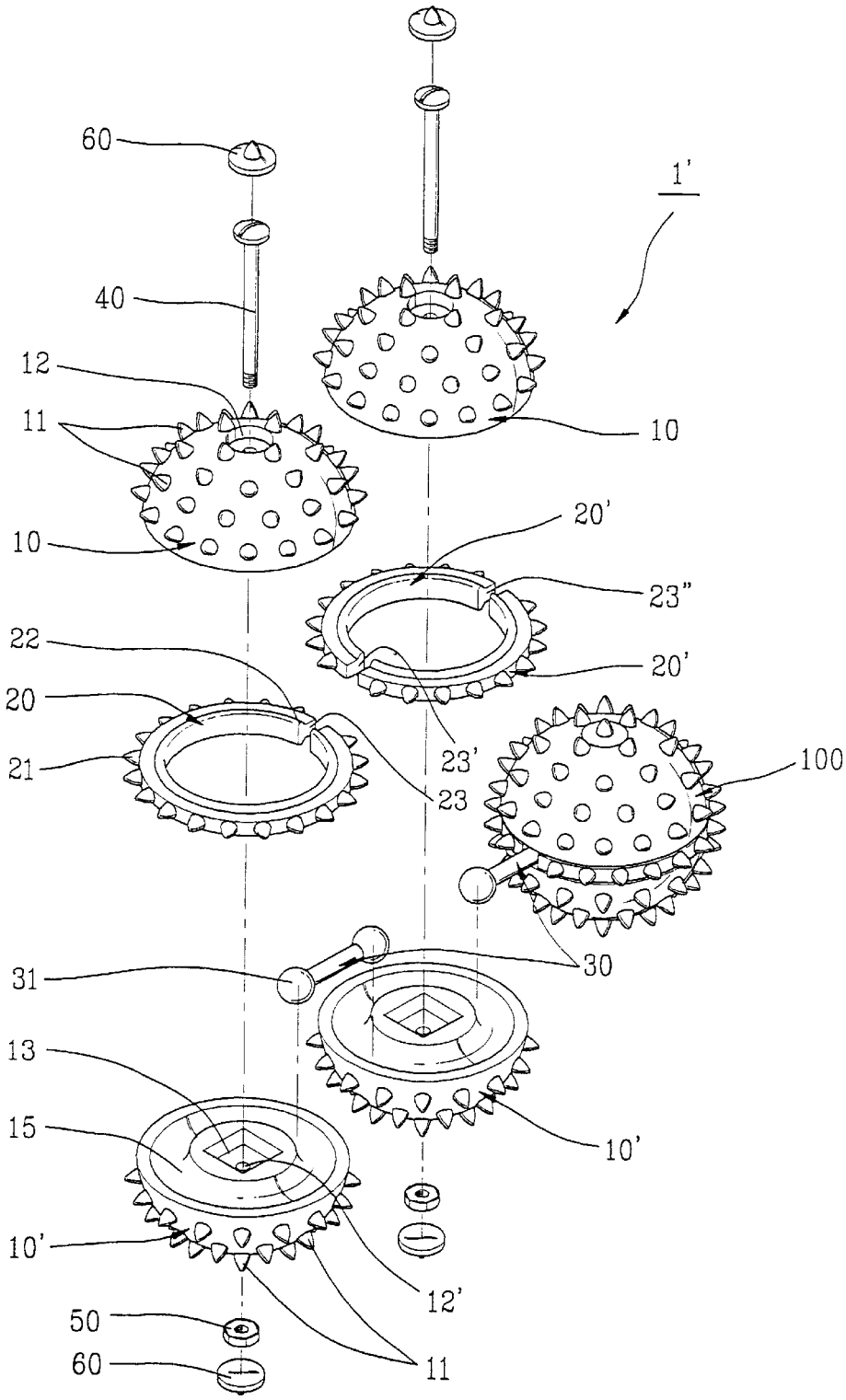
FIG. 8 is a disassembled perspective view of a second embodiment of the present invention.
Figure 9:
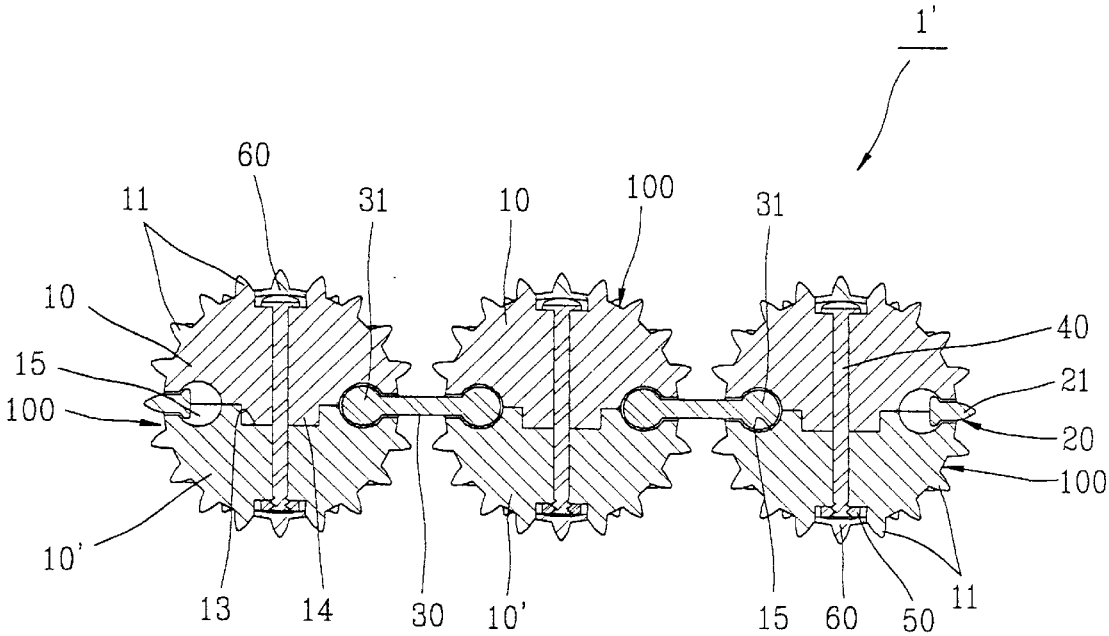
FIG. 9 is a cross-sectional view of the second embodiment of the present invention.

As shown in FIG. 8 and FIG. 9, the finger pressure device 100 can include three connecting spherical finger pressure devices 100, and the middle spherical finger pressure device 100 has spaces 23', 23" on both sides of the semi-spherical bodies 10, 10'. This finger pressure device 1' has the same effect with the present invention and is more effective to adults who have a larger hand.

As above, the object of the present invention is to overcome the drawbacks of the conventional finger pressure devices and provide an effect of improving blood circulation by press-stimulating artery points distributed on a palm and fingers by revolving two spherical finger pressure devices in various directions and also more convenient portability and a function as an amusement tool.

What is claimed is:

1. A finger pressure device comprising:

at least two spherical bodies, each formed by first and second semi-spherical bodies, said first semi-spherical body including:

a first outer surface, a first inner surface, a plurality of first protuberances on the first outer surface, a first bore extending therethrough, a concavity at the first inner surface, and an annular groove in the first inner surface between the first outer surface and the concavity;

said second semi-spherical body including:

a second outer surface, a second inner surface, a plurality of second protuberances on the second outer surface, a second bore extending therethrough, a convexity at the second inner surface for mating with the concavity of the first semi-spherical body, and an annular groove in the second inner surface between said second outer surface and the convexity;

a bolt arrangement extending through the bores of said first and second semi-spherical bodies for securing said first and second semi-spherical bodies together;

an annular rim associated with each said spherical body, each said annular rim positioned between the first and second semi-spherical bodies of the respective spherical body, each said annular rim including:

a rim outer surface, a rim inner surface, a plurality of rim protuberances on the rim outer surface, a projection on the rim inner surface, and a first radial gap which defines first and second opposing surfaces;

at least one coupling rod, each for connecting together two of said spherical bodies, each said coupling rod including:

a central rod extending through radial gaps of the annular rims of first and second ones of said spherical bodies, and first and second spherical protuberances on opposite ends of said central rod, said first spherical protuberance inserted into the annular grooves of the first and second semi-spherical bodies of the first one of said spherical bodies and said second spherical protuberance inserted into the annular grooves of the first and second semi-spherical bodies of the second one of said spherical bodies; and caps covering the bores at the outer surfaces of the part-spherical bodies after the first and second semi-spherical bodies of each spherical body have been secured together by said bolt arrangement.

2. A finger pressure device according to claim 1, wherein one said annular rim has a second radial gap spaced from said first radial gap.

3. A finger pressure device according to claim 2, wherein said first and second radial gaps are diametrically opposite each other.

4. A finger pressure device according to claim 1, wherein:

the first bore in said first semi-spherical body extends radially therethrough and extends through said concavity; and the second bore in said second semi-spherical body extends radially therethrough and extends through said convexity.

5. A finger pressure device according to claim 1, wherein said bolt arrangement includes a bolt that extends through the first and second bores, and a nut secured to an end of the bolt.

6. A finger pressure device according to claim 1, wherein there are two said spherical bodies that are connected together by one coupling rod.

7. A finger pressure device according to claim 1, wherein there are three said spherical bodies that are connected together by two coupling rods.

* * * * *